US008104383B2

(12) United States Patent
Lai

(10) Patent No.: US 8,104,383 B2
(45) Date of Patent: Jan. 31, 2012

(54) TORQUE SOCKET ASSEMBLY

(76) Inventor: Jin-Tsai Lai, Taichung (TW)

( * ) Notice: Subject to any disclaimer, the term of this patent is extended or adjusted under 35 U.S.C. 154(b) by 280 days.

(21) Appl. No.: 12/604,363

(22) Filed: Oct. 22, 2009

(65) Prior Publication Data

US 2011/0094354 A1 Apr. 28, 2011

(51) Int. Cl.
*B25B 23/157* (2006.01)

(52) U.S. Cl. ..... 81/475

(58) Field of Classification Search ..... 81/472–476
See application file for complete search history.

(56) References Cited

U.S. PATENT DOCUMENTS 3,472,102 A * 10/1969 Komsa et al. ..... 81/468
4,272,973 A * 6/1981 Fu-Tsai ..... 464/23
5,437,524 A * 8/1995 Huang ..... 408/139
7,222,559 B2 * 5/2007 Wang ..... 81/467
7,281,458 B2 * 10/2007 Chuang ..... 81/475
7,334,509 B1 * 2/2008 Gao ..... 81/475

* cited by examiner

*Primary Examiner* — Debra S Meislin

(57) ABSTRACT

A torque socket assembly includes a first connecting portion which has a positioning hole and a fitting hole respectively defined in two ends thereof. A second connecting portion which has a driving hole and a receiving hole respectively defined in two ends thereof. The fitting hole and the receiving hole respectively have a first and a second positioning block disposed therein. A first and a second gear teeth are respectively disposed on the first and the second positioning block and are meshed with each other. A through hole is penetrated through the first and the second connecting portion, and the positioning blocks. A torque setting unit includes a resilient piece, a rod, and a screwing nut. The rod is inserted through the through hole, and the screwing nut is fastened to a second end of the rod for setting a stable torque value to the torque socket assembly.

7 Claims, 9 Drawing Sheets

TORQUE SOCKET ASSEMBLY

BACKGROUND OF THE INVENTION

1. Field of the Invention

The present invention relates to a torque socket assembly, and more particularly, to a torque socket assembly providing a stable torque value.

2. Description of Related Art

A conventional socket assembly commonly known in accordance with the prior art comprises a receiving portion, a driving portion, and a middle portion disposed in between the receiving portion and the driving portion. The receiving portion has a quadrangular hole for adapting to co-operate with a driving tool. The driving portion is a polygon-shaped hole for adapting to receive a fastener (i.e. a bolt). The middle portion has a plurality of embossed patterns and a plurality of smooth faces alternately and annularly formed on the outer periphery thereof. The embossed patterns provide increment to the friction when the socket assembly is grasped by hands, such that a user may selectively adapts the socket assembly to a driving tool or simply grasps the socket assembly by hands for operation.

However, the conventional socket assembly bears several disadvantages. First of all, the conventional socket assembly does not include a torque adjusting unit therefore it is not capable to provide a predetermined torque. When in operation, the user can merely tighten the fastener with an object, and is unable to determine whether the torque applied is sufficient to securely fasten the fastener with the object. In addition, the user is not acknowledged if the torque applied has reached the torque required, which may consequently lead to over-tightening of the fastener. Nevertheless, high precision in a torque applied is often required when applying a socket assembly to fasten a fastener with the object; even minor errors in the torque applied may lead to unexpected result. Due to the lack of the torque adjusting unit of the conventional socket assembly, when a stable torque is required for fastening a series of fasteners, it is difficult for the user to apply a same force continuously, which may easily lead to slight variations in the torque values. Therefore, the conventional socket assembly is inconvenient to use.

The present invention has arisen to obviate/mitigate the disadvantages of the conventional torque socket assembly.

SUMMARY OF THE INVENTION

The main objective of the present invention is to provide a torque socket assembly which provides stable torque value.

To achieve the objective, a torque socket assembly comprises a first connecting portion which has a positioning hole and a fitting hole respectively defined in a first end and a second end thereof. The fitting hole has a first positioning block disposed therein. A first gear teeth is disposed on a surface of the first positioning block. A second connecting portion has a receiving hole and a driving hole respectively defined in a first end and a second end thereof. The receiving hole has a second positioning block disposed therein. The first positioning block and the second positioning blocks are in polygon-shape. The fitting hole and the receiving hole are polygon-shaped and corresponded to a shape of the positioning blocks such that the positioning blocks are firmly secured in the fitting hole and the receiving hole respectively. The fitting hole has a shape which is identical to that of the receiving hole. A second gear teeth is disposed on a surface of the second positioning block and meshed with the first gear teeth for connecting the first connecting portion and the second connecting portion. A securing flange is annularly formed on an outer periphery of the second connecting portion. The securing flange is abutted against the first connecting portion for engaging the second connecting portion with the first connecting portion. A sleeve is sleeved on the outer periphery of the second connecting portion. Wherein the sleeve is rotated relative to the second connecting portion for providing a firmly gripping operation. A through hole is penetrated through the first connecting portion, the second connecting portion, and the positioning blocks.

A torque setting unit includes a resilient piece which is interposed between the first connecting portion and the first positioning block, a rod which has a positioning portion formed on a first end thereof, and a screwing nut which is screwed to a second end of the rod. The positioning portion is polygon-shaped. The positioning hole is polygon-shaped corresponded to a shape of the positioning portion such that the positioning portion is firmly secured in the positioning hole. Wherein the rod is inserted into the first connecting portion, the resilient piece, the first positioning block, the second positioning block, and the second connecting portion via the through hole. The positioning portion is fixedly secured in the positioning hole, and the screwing nut is fastened the second end of the rod within the driving hole for setting a stable torque value to the torque socket assembly.

In accordance with another aspect of the present invention, an elastic unit is disposed in the receiving hole. The elastic unit is interposed between a bottom of the receiving hole and the positioning block.

Further benefits and advantages of the present invention will become apparent after a careful reading of the detailed description with appropriate reference to the accompanying drawings.

DETAILED DESCRIPTION OF THE INVENTION

Figures 1, 2:
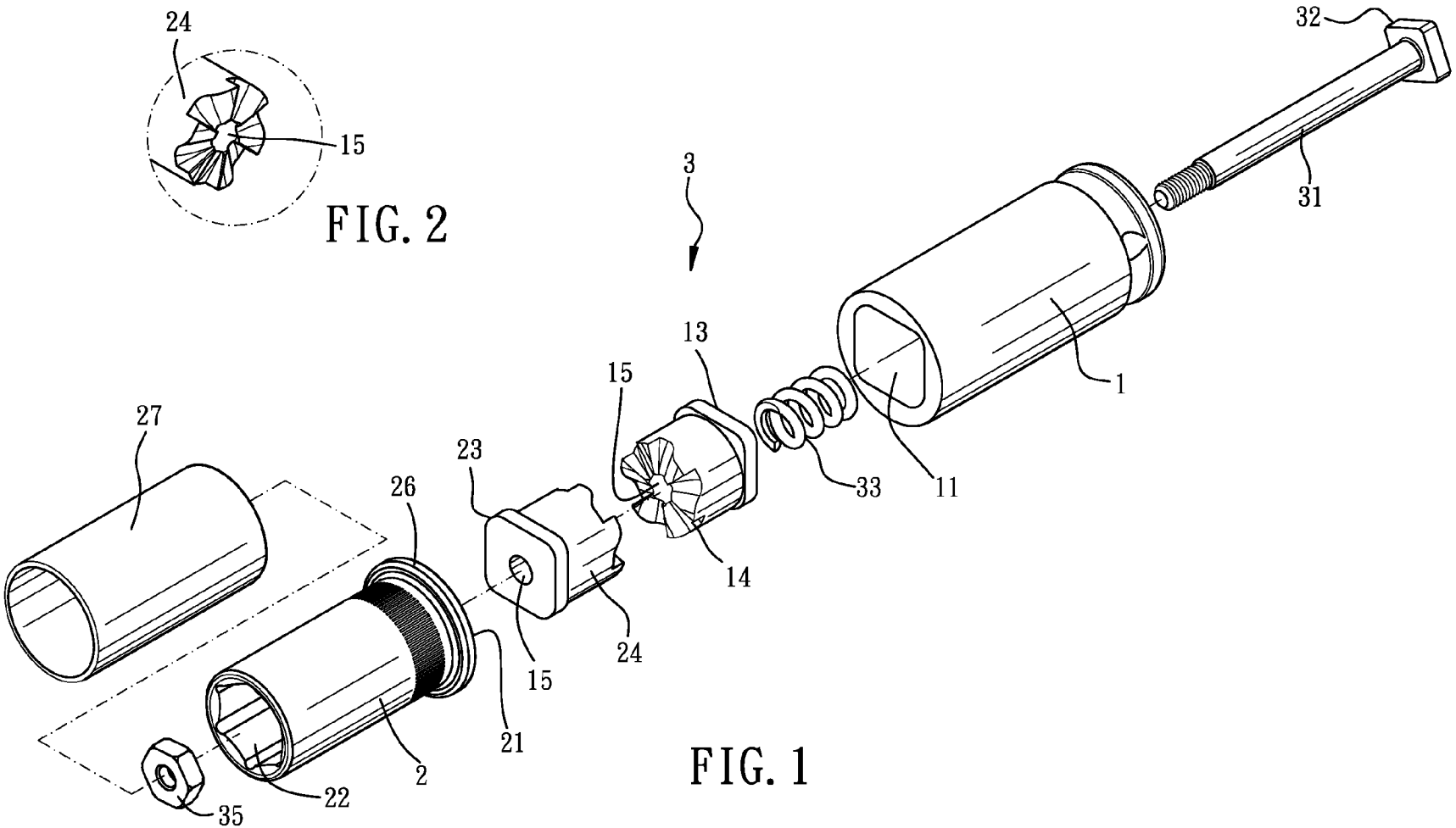
FIG. 1 is an exploded perspective view to show the torque socket assembly in accordance with the present invention.
FIG. 2 is a perspective view of a second gear teeth of the torque socket assembly in accordance with the present invention.
Figure 3:
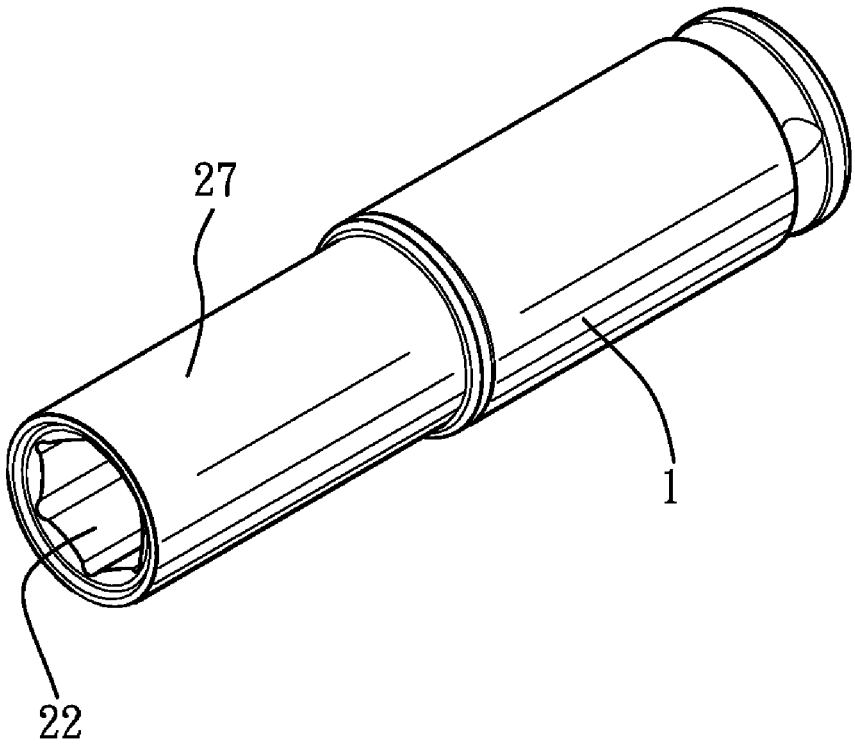
FIG. 3 is an assembled perspective view of the torque socket assembly in accordance with the present invention.

Referring to FIGS. 1 to 5, a torque socket assembly of the present invention comprises a first connecting portion 1 in a tubular shape which has a positioning hole 12 adapted to connect with a driving tool (i.e. a ratchet wrench) and defined in a first end thereof. A fitting hole 11 is defined in a second end of the first connecting portion 1. The fitting hole 11 has a first positioning block 13 received therein. A first gear teeth 14 is disposed on a surface of the first positioning block 13. A second connecting portion 2 has a driving hole 22 which is adapted to receive a fastener (i.e. a bolt) defined in a first end thereof. The second connecting portion 2 has a receiving hole 21 defined in a second end thereof. The second connecting portion 2 is in a tubular shape and has an outer periphery smaller than that of the first connecting portion 1. The receiving hole 21 has a second positioning block 23 received therein. A second gear teeth 24 is disposed on a surface of the second positioning block 23 and meshed with the first gear teeth 14 for internally connecting the first connecting portion 1 and the second connecting portion 2. The first positioning block 13 and the second positioning block 23 are in polygon-shaped. The fitting hole 11 and the receiving hole 21 are polygon-shaped and correspond to the shape of the positioning blocks 13, 23 such that the positioning blocks 13, 23 are firmly secured in the fitting hole 11 and the receiving hole 21 respectively. In the present embodiment, the positioning blocks 13, 23, the fitting hole 11, and the receiving hole 21 are rectangular (as shown in FIG. 1.). The fitting hole 11 has a shape which is identical to that of the receiving hole 21 such that the fitting hole 11 and the receiving hole 21 confined a moving space for the positioning blocks 13, 23 and the gear teeth 14, 24 to move therein. A securing flange 26 is annularly formed on an outer periphery of the second connecting portion 2 and is abutted against the first connecting portion 1 for engaging the second connecting portion 2 with the first connecting portion 1. The securing flange 26 confined the second connecting portion 2 relative to the first connecting portion 1. A sleeve 27 is slippedly sleeved on the outer periphery of the second connecting portion 2; wherein the sleeve 27 is rotated relative to the second connecting portion 2 for providing a firmly gripping operation. A through hole 15 is axially penetrated through the first connecting portion 1, the second connecting portion 2, and the positioning blocks 13, 23.

A torque setting unit 3 includes a resilient piece 33, a rod 31, and a screwing nut 35. The resilient piece 33 is interposed between the first connecting portion 1 and the first positioning block 13. The rod 31 has a positioning portion 32 formed on a first end thereof. The screwing nut 35 is screwed to a threaded portion (not numbered) of a second end of the rod 31. The positioning portion 32 of the rod 31 is polygon-shaped. The positioning hole 12 is polygon-shaped corresponded to the shape of the positioning portion 32 such that the positioning portion 32 is firmly secured in the positioning hole 12. In the present invention, the positioning portion 32 and the positioning hole 12 are rectangular-shaped. The rod 31 is axially inserted into the first connecting portion 1, the resilient piece 33, the first positioning block 13, the second positioning block 23, and the second connecting portion 2 via the through hole 15. The rod 31 is piercingly engaged to the positioning blocks 13, 23 and the gear teeth 14, 24 respectively disposed in the first connecting portion 1 and the second connecting portion 2. The positioning portion 32 is fixedly secured in a bottom of the positioning hole 12. The screwing nut 35 is fastened to the threaded portion of the second end of the rod 31 within the driving hole 22 for presetting a stable torque value.

Figure 4:
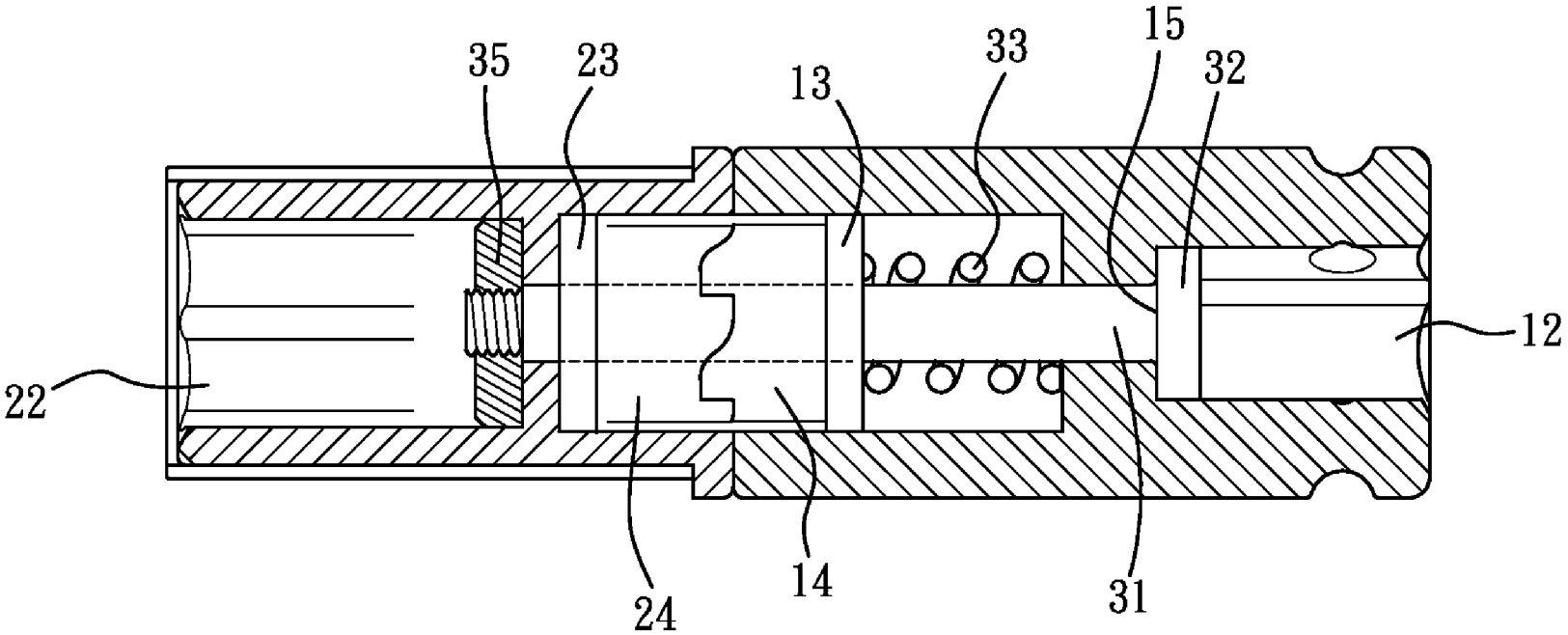
FIG. 4 is a cross sectional view to show the torque socket assembly in accordance with the present invention as the gear teeth are meshed with each other.
Figure 5:
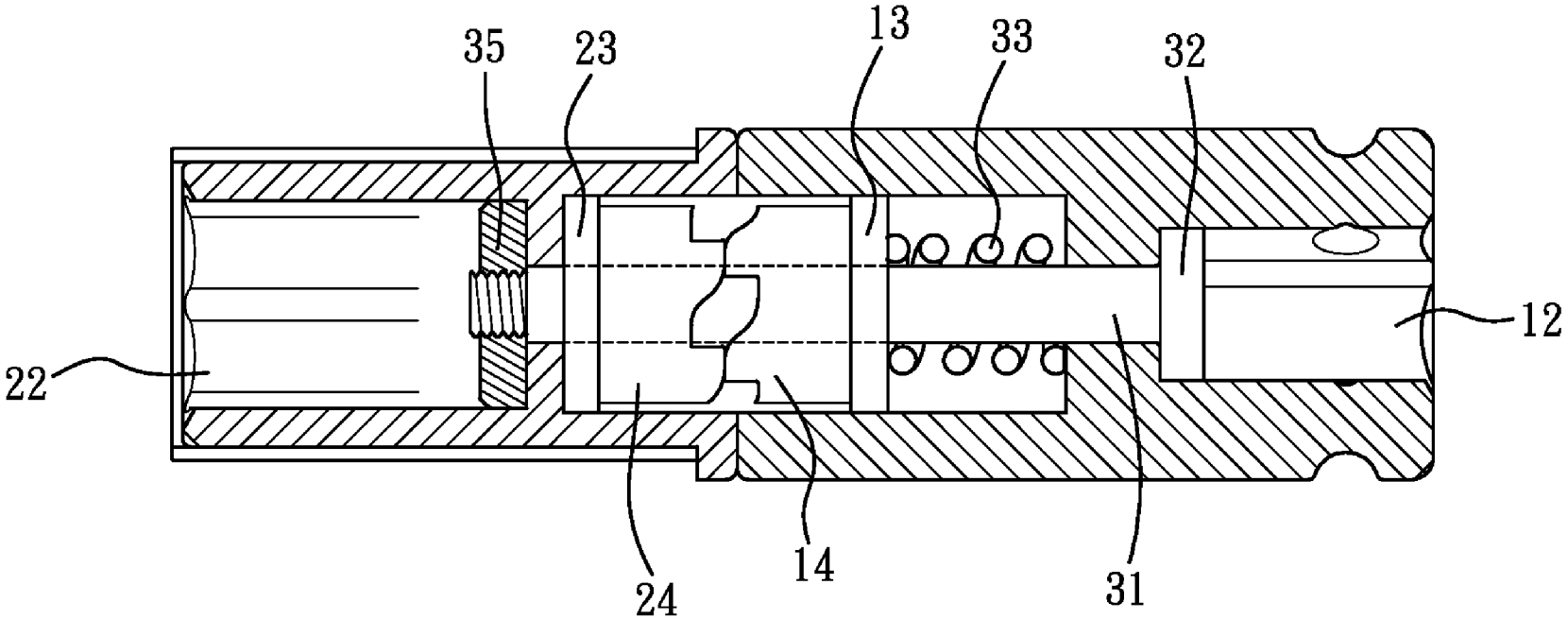
FIG. 5 is a cross sectional view to show of the torque socket assembly in accordance with the present invention as the gear teeth abut against each other when a force exerted has exceeded a preset torque value.
Figure 6:
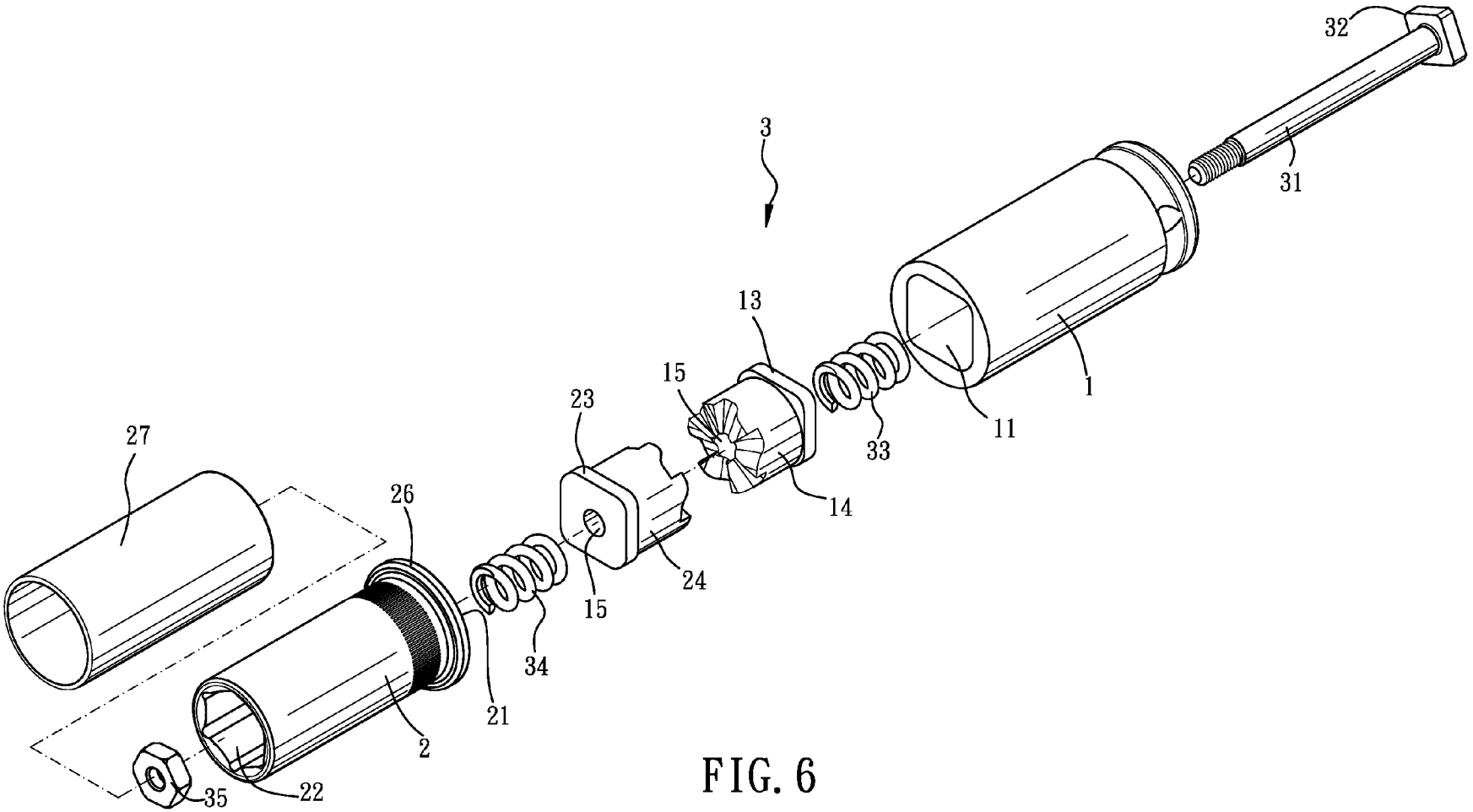
FIG. 6 is an exploded perspective view to show a second embodiment of the torque socket assembly in accordance with the present invention.
Figure 7:
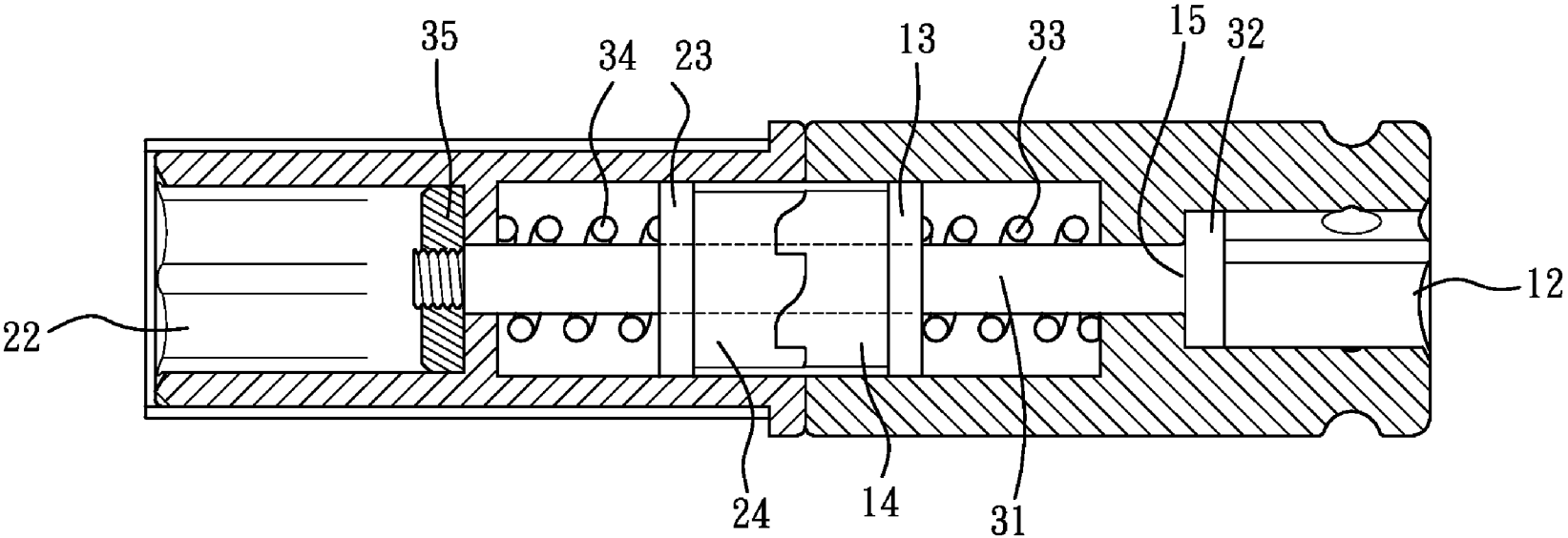
FIG. 7 is a cross sectional view to show the second embodiment of the torque socket assembly in accordance with the present invention as the gear teeth are meshed with each other.
Figure 8:
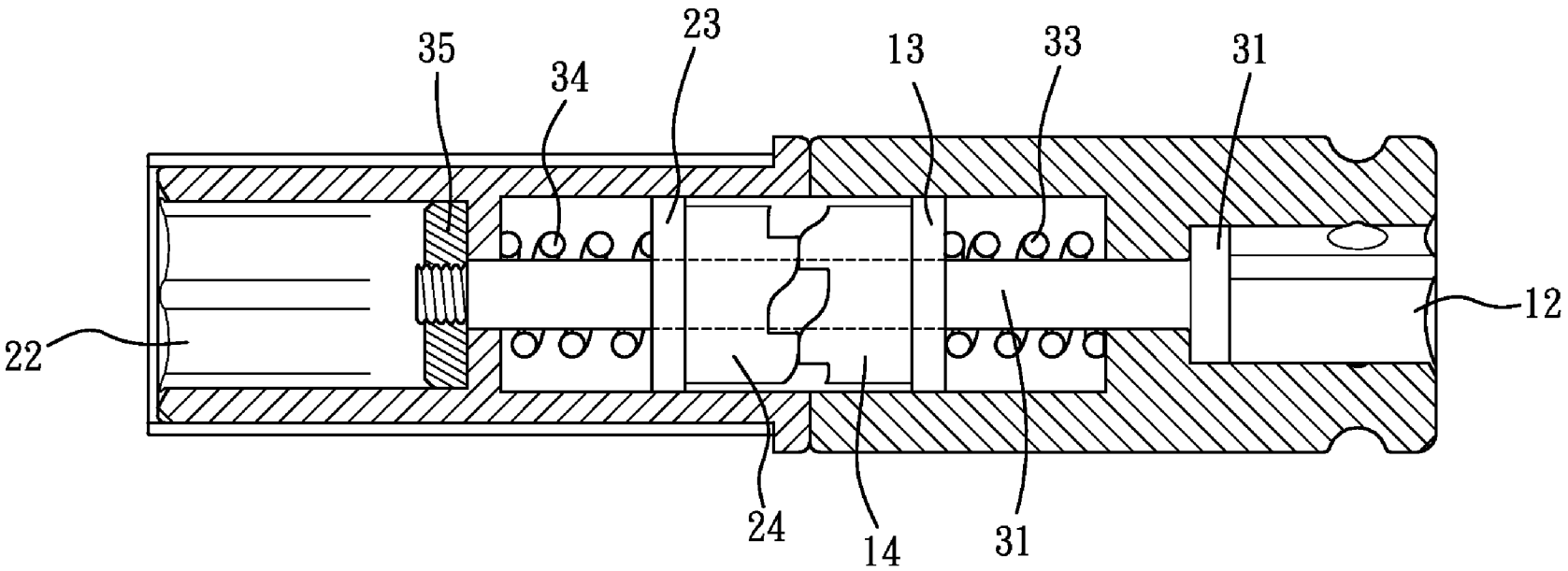
FIG. 8 is a cross sectional view to show the second embodiment of the torque socket assembly in accordance with the present invention as the gear teeth abut against each other when the force exerted has exceeded the preset torque value.

As shown in FIG. 5, when an applying force has exceeded a preset torque value, the first gear teeth 14 cannot drive the second gear teeth 24, and the first gear teeth 14 is rotated relative to and abutted against the second gear teeth 24 in the moving space confined in the first connecting portion 1 and the second connecting portion 2. A user is acknowledged that the preset torque value is reached. Further, when the driving hole 22 is retrieved from the fastener, the first gear teeth 14 is reversely rotated to an initial position wherein the first gear teeth 14 is meshed with the second gear teeth 24 (as shown in FIG. 4), the torque socket assembly is reinstated to an initial state wherein the torque is within the range of its preset value, allowing the user to instantly access the fastener again without setting the torque value such that a stable torque value can be continuously applied.

With reference to FIG. 6 to FIG. 10, that shows a second embodiment of the torque socket assembly in accordance with the present invention. The elements and effects of the second embodiment which are the same with the first embodiment are not described, only the differences are described. In this embodiment, an elastic unit 34 is disposed in the receiving hole 21. The elastic unit 34 is interposed between a bottom of the receiving hole 21 and the second positioning block 23. Two ends of the elastic unit 34 are respectively abutted against the bottom of the receiving hole 21 and the second positioning block 23. The elastic unit 34 co-operates with the resilient piece 33, such that the positioning blocks 13, 23 and the gear teeth 14, 24 are evenly applied by the resilient piece 33 and the elastic unit 34 in the first connecting portion 1 and the second connecting portion 2. In addition, a co-operation of the resilient piece 33 and the elastic unit 34 provides a wider range of the torque value that can be preset.

Figure 9:
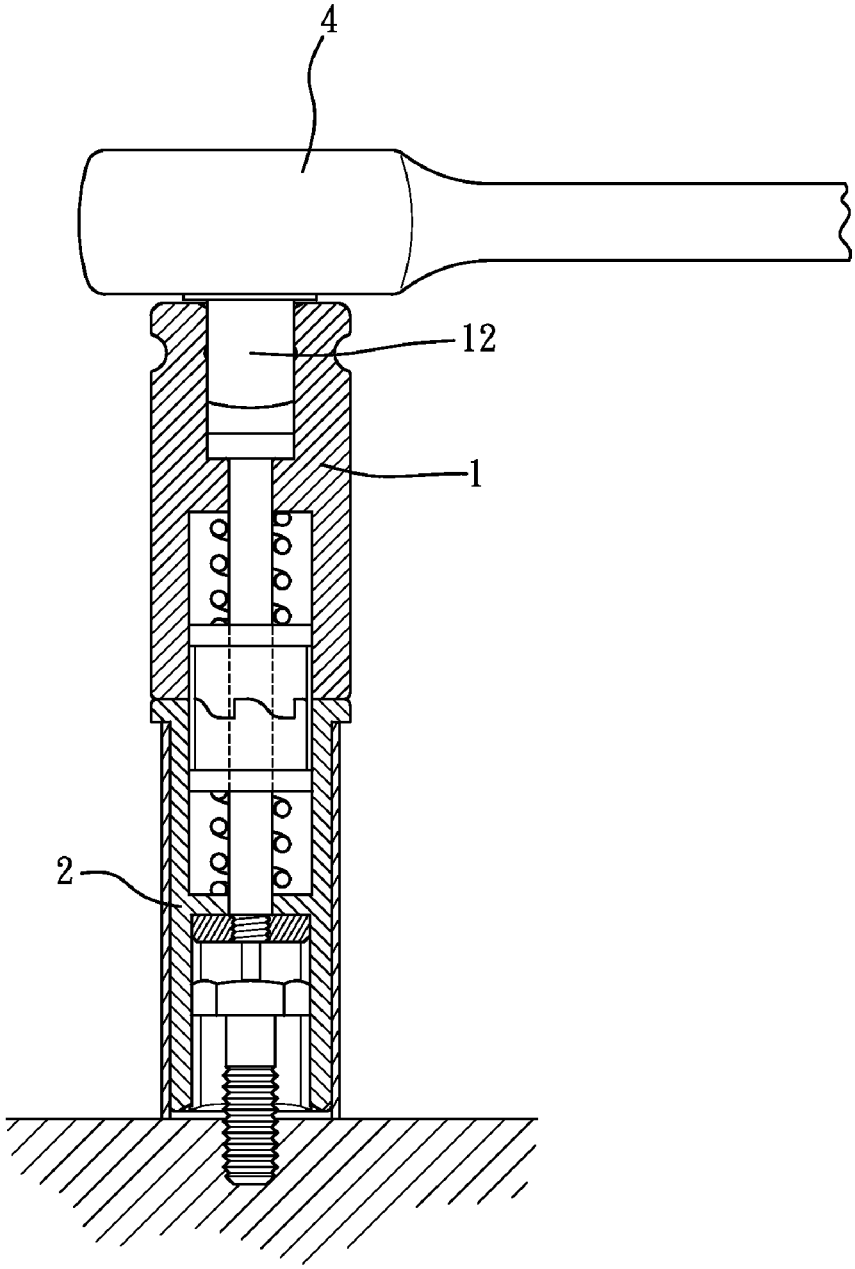
FIG. 9 is a cross sectional view to show the torque socket assembly in accordance with the present invention co-operating with a ratchet wrench.
Figure 10:
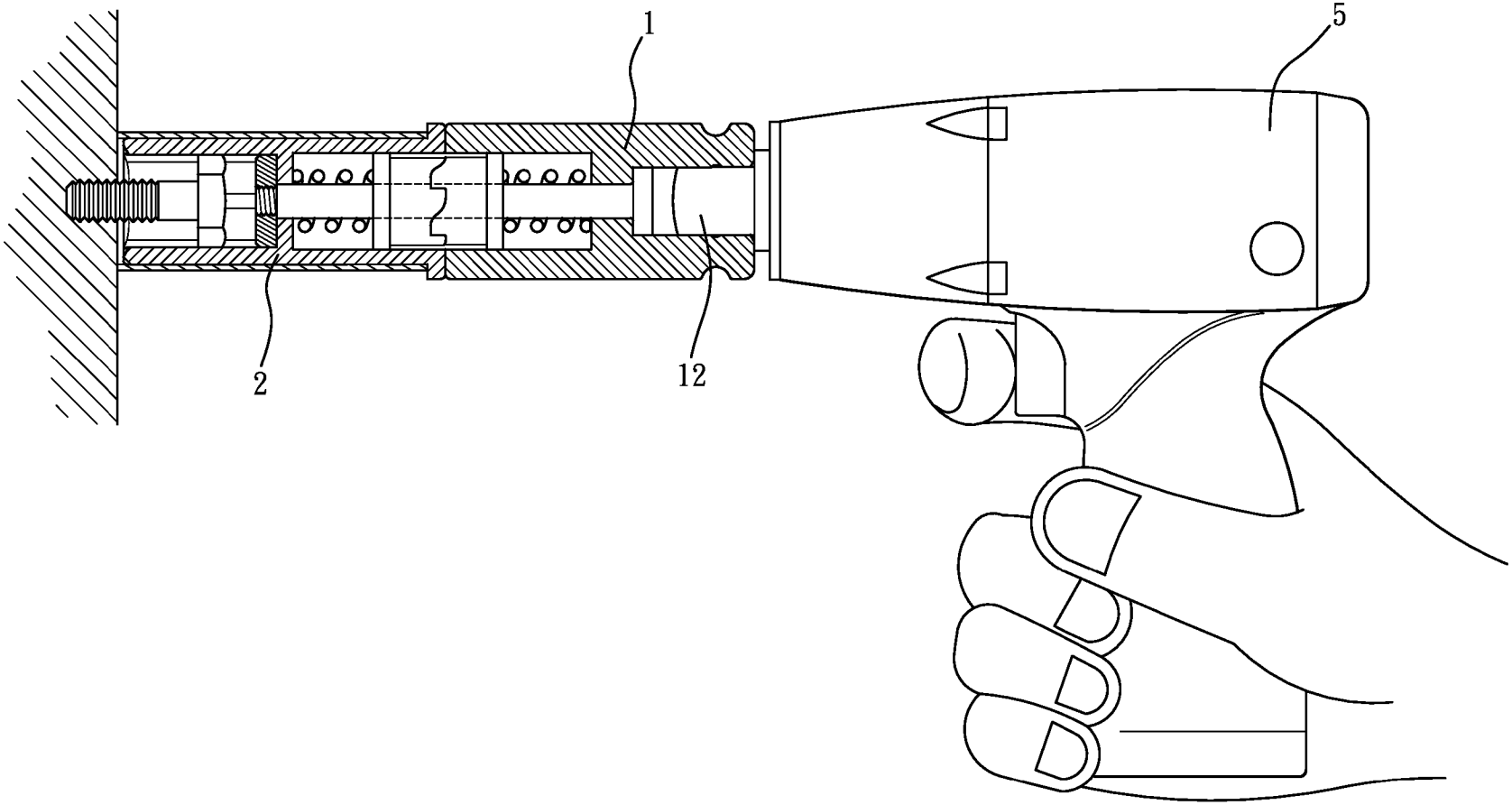
FIG. 10 is a cross sectional view to show the torque socket assembly in accordance with the present invention co-operating with a pneumatic tool.

Furthermore, as shown in FIG. 9 to FIG. 10, the torque socket assembly of the present invention is adapted to co-operate with various driving tools. FIG. 9 shows the torque socket assembly of the present invention connected to a ratchet wrench 4; wherein FIG. 10 shows the present invention connected to a pneumatic driving tool 5.

Although the invention has been explained in relation to its preferred embodiment, it is to be understood that many other possible modifications and variations can be made without departing from the spirit and scope of the invention as hereinafter claimed.

What is claimed is:

1. A torque socket assembly comprising:

a first connecting portion having a positioning hole and a fitting hole respectively defined in a first end and a second end thereof; the fitting hole having a first positioning block received therein; a first gear teeth disposed on a surface of the first positioning block;

a second connecting portion having a driving hole and a receiving hole respectively defined in a first end and a second end thereof; the receiving hole having a second positioning block disposed therein, a second gear teeth disposed on a surface of the second positioning block and meshed with the first gear teeth for connecting the first connecting portion and the second connecting portion; a through hole penetrated through the first connecting portion, the second connecting portion, the first positioning block, and the second positioning block; and a torque setting unit including a resilient piece interposed between the first connecting portion and the first positioning block, a rod having a positioning portion formed on a first end thereof, and a screwing nut screwed to a second end of the rod;

wherein the rod is inserted into the first connecting portion, the resilient piece, the first positioning block, the second positioning block, and the second connecting portion via the through hole, the positioning portion fixedly secured in the positioning hole, the screwing nut fastened the second end of the rod within the driving hole for setting a stable torque value to the torque socket assembly.

2. The torque socket assembly as claimed in claim 1, further comprising an elastic unit disposed in the receiving hole, the elastic unit interposed between a bottom of the receiving hole and the second positioning block.

3. The torque socket assembly as claimed in claim 1, wherein the first positioning block and the second positioning block are in polygon-shape; the fitting hole and the receiving hole being polygon-shaped, corresponding to a shape of the first positioning block and the second positioning block such that the first positioning block and the second positioning block are firmly secured in the fitting hole and the receiving hole respectively.

4. The torque socket assembly as claimed in claim 1 further comprising a securing flange annularly formed on an outer periphery of the second connecting portion; wherein the securing flange is abutted against the first connecting portion for engaging the second connecting portion with the first connecting portion.

5. The torque socket assembly as claimed in claim 1, wherein the positioning portion of the rod is polygon-shaped; the positioning hole being polygon-shaped corresponding to a shape of the positioning portion such that the positioning portion is firmly secured in the positioning hole.

6. The torque socket assembly as claimed in claim 1, further comprising a sleeve sleeving on the outer periphery of the second connecting portion; wherein the sleeve is rotated relative to the second connecting portion for providing a firmly gripping operation.

7. The torque socket assembly as claimed in claim 1, wherein a shape of the fitting hole is identical with that of the receiving hole.

* * * * *